US009924573B2

(12) United States Patent
Howe et al.

(10) Patent No.: US 9,924,573 B2
(45) Date of Patent: Mar. 20, 2018

(54) MULTI-STAGE LED DRIVER WITH CURRENT PROPORTIONAL TO RECTIFIED INPUT VOLTAGE AND LOW DISTORTION

(71) Applicant: IXYS Corporation, Milpitas, CA (US)

(72) Inventors: Bret Ross Howe, Irvine, CA (US); Narasimham Patibandla, Lake Forest, CA (US)

(73) Assignee: IXYS Corporation, Milpitas, CA (US)

( * ) Notice: Subject to any disclaimer, the term of this patent is extended or adjusted under 35 U.S.C. 154(b) by 0 days.

(21) Appl. No.: 15/365,547

(22) Filed: Nov. 30, 2016

(65) Prior Publication Data

US 2017/0181232 A1 Jun. 22, 2017

Related U.S. Application Data

(63) Continuation of application No. 14/978,783, filed on Dec. 22, 2015, now Pat. No. 9,544,961.

(51) Int. Cl.
*H05B 33/00* (2006.01)
*H05B 33/08* (2006.01)

(52) U.S. Cl.
CPC ..... *H05B 33/083* (2013.01); *H05B 33/0809* (2013.01)

(58) Field of Classification Search
CPC ..... H05B 33/083; H05B 33/0809; H05B 33/0815; H05B 33/0824; H05B 33/0827; H05B 33/0845; H05B 33/0887; H05B 33/0812; H05B 33/0857; H05B 37/02; H05B 33/0818; H05B 33/086; H05B 33/0866
See application file for complete search history.

(56) References Cited

U.S. PATENT DOCUMENTS

| | | | | |
|---|---|---|---|---|
| 4,296,413 | A | 10/1981 | Milkovic | 340/870.38 |
| 9,101,019 | B2 | 8/2015 | Jong et al. | |
| 2013/0082602 | A1* | 4/2013 | Bradford | H05B 33/0893 315/122 |
| 2013/0187572 | A1 | 7/2013 | Grajcar | 315/312 |

* cited by examiner

*Primary Examiner* — Monica C King
(74) *Attorney, Agent, or Firm* — Imperium Patent Works; T. Lester Wallace; Amir V. Adibi

(57) ABSTRACT

A system for driving a multi-stage LED with low distortion and with current proportional to rectified input voltage is disclosed. In an exemplary embodiment, an apparatus includes LED groups connected in series to form an LED string having a first node, a last node, and intermediate nodes. The apparatus also includes current cells having inputs coupled to the nodes and outputs coupled to an output resistor. Each current cell selectively regulates current to flow between its respective input and the output resistor. The apparatus also includes a feedback circuit that generates a plurality of feedback voltages from a voltage level at the output resistor. When a selected current cell is enabled by a selected feedback voltage to regulate a selected current level from its respective input to the output resistor, upstream current cells are disabled by their respective feedback voltages.

15 Claims, 9 Drawing Sheets

MULTI-STAGE LED DRIVER WITH CURRENT PROPORTIONAL TO RECTIFIED INPUT VOLTAGE AND LOW DISTORTION

CROSS-REFERENCE TO RELATED APPLICATIONS

This application is a continuation of, and claims priority under 35 U.S.C. § 120 from, nonprovisional U.S. patent application Ser. No. 14/978,783 entitled "Multi-Stage LED Driver With Current Proportional To Rectified Input Voltage And Low Distortion," filed on Dec. 22, 2015, now U.S. Pat. No. 9,544,961, the subject matter of which is incorporated herein by reference.

TECHNICAL FIELD

The present disclosure relates generally to LED lighting, and more particularly to LED driver circuitry.

BACKGROUND INFORMATION

Light Emitting Diode (LED) bulbs are commonly employed in commercial and residential lighting applications. A typical LED bulb may include several stages of LED devices. Conventional systems may experience large current spikes as the stages are enabled and disabled by the driver circuitry. These large current spikes can lead to noise and distortion. Furthermore, cost is often a concern when installing LED bulbs in buildings and residences. Driver circuitry that drives LED bulbs from an AC power source can become cost prohibitive. Therefore, an LED driver circuit having low noise, distortion, and cost is desirable.

SUMMARY

A system comprises a multi-stage LED driver, a plurality of LED groups, a voltage rectifier, and a power source. In one example, the plurality of LED groups includes a first LED group, a second LED group, and a third LED group that are connected in series to form an LED string. The LED string includes a first node (N1), a last node (N4), and one or more intermediate nodes (N2 and N3). The voltage rectifier receives an AC voltage (VAC) from the power source and generates an LED drive signal. The LED drive signal is supplied to the LED string via the first node N1. The multi-stage LED driver turns on one or more of the LED groups by controlling how current flows through each of the LED groups.

In one example, the multi-stage LED driver comprises a plurality of current cells, a voltage reference circuit, a feedback circuit, and an output node. The current cells have an input coupled to one of the first, last, or intermediate nodes. Each current cell selectively enables and regulates current to flow between its respective input to the output node based on an associated feedback voltage generated by the feedback circuit. When a downstream current cell is enabled, upstream current cells are disabled by their respective feedback voltages. During each rectified voltage cycle, the LED groups turn on in a progression beginning with the most upstream LED group until all of the LED groups are turned on and the peak rectified voltage level is reached. When the rectified voltage level starts decreasing, the LED groups begin to turn off in a progression beginning with the most downstream LED group until all of the LED groups are turned off.

The foregoing is a summary and thus contains, by necessity, simplifications, generalizations and omissions of detail; consequently it is appreciated that the summary is illustrative only. Still other methods, and structures and details are set forth in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

Reference will now be made in detail to exemplary embodiments of the invention, examples of which are illustrated in the accompanying drawings.

DETAILED DESCRIPTION

Figure 1:
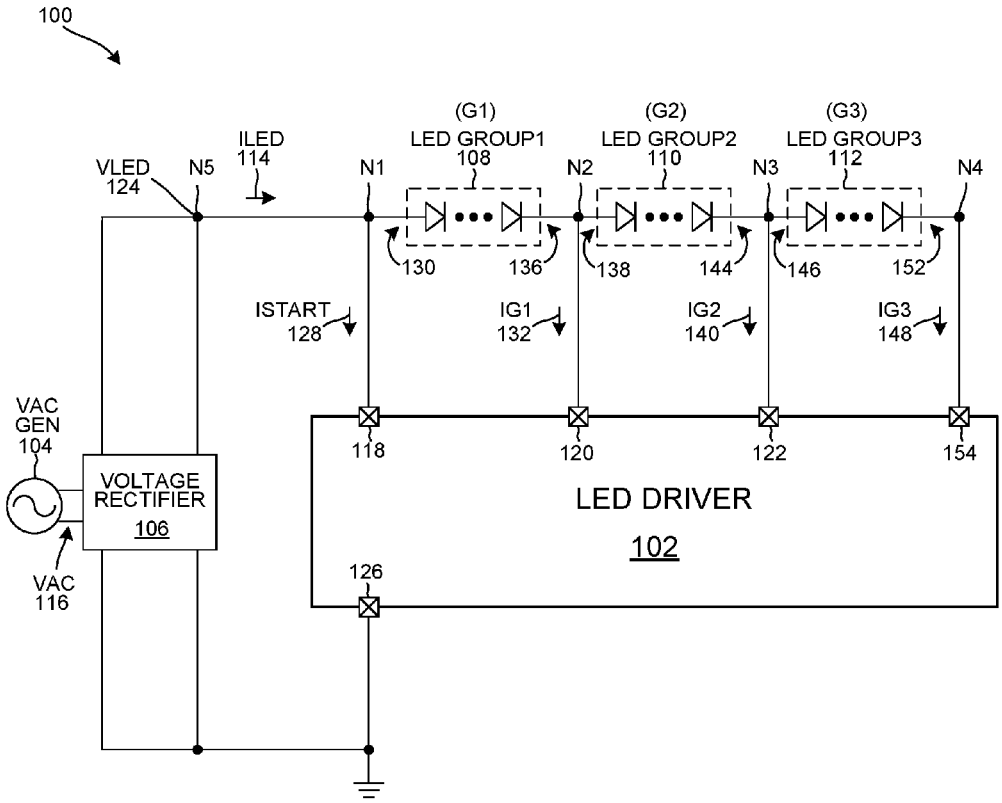
FIG. 1 shows a diagram of a system that includes an exemplary embodiment of a multi-stage LED driver.

FIG. 1 shows a high level diagram of a system 100 that includes an exemplary embodiment of a multi-stage LED driver 102.

The system 100 includes the multi-stage LED driver 102, an AC voltage generator 104, a voltage rectifier 106, a first group of LEDs (G1) 108, a second group of LEDs (G2) 110, and a third group of LEDs (G3) 112. The voltage rectifier 106 receives an AC voltage (VAC) 116 from AC voltage generator 104 and generates therefrom an LED drive signal at node N5 having a voltage VLED 124 and a current ILED 114. VLED 124 of the LED drive signal is a rectified version of the VAC 116 input. The LED driver 102 turns on (or energizes) one or more of the LED groups 108, 110, and 112 by controlling how current flows through each of the LED groups 108, 110, and 112.

In an exemplary embodiment, the LED driver 102 has four terminals that include terminals 118, 120, 122, and 154 coupled to various LED nodes, and a ground terminal 126. Terminal 118 is coupled to receive current signal ISTART 128 from node N1. The node N1 is coupled between a first end 130 of the first LED group 108 and the node N5 at the output of the voltage rectifier 106. Terminal 120 is coupled to receive current signal IG1 132 from node N2. The node N2 is coupled between a second end 136 of the first LED group 108 and a first end 138 of the second LED group 110. Terminal 122 is coupled to receive current signal IG2 140 from node N3. The node N3 is coupled between a second end 144 of the second LED group 110 and a first end 146 of the third LED group 112. Terminal 154 is coupled to receive current signal IG3 148 from node N4. The node N4 is coupled between a second end 152 of the third LED group 112 and terminal 154 of the LED driver 102.

The first group 108, second group 110, and third group 112 of LEDs are connected in series to form an LED string. The node N1 is an input (first) node of the LED string. The nodes N2 and N3 are intermediate nodes of the LED string. The node N4 is an output (last) node of the LED string. Each LED group comprises one or more LED devices. As a voltage is applied and current passes through an LED group, the LED devices within the group are energized to emit light.

Figure 2:
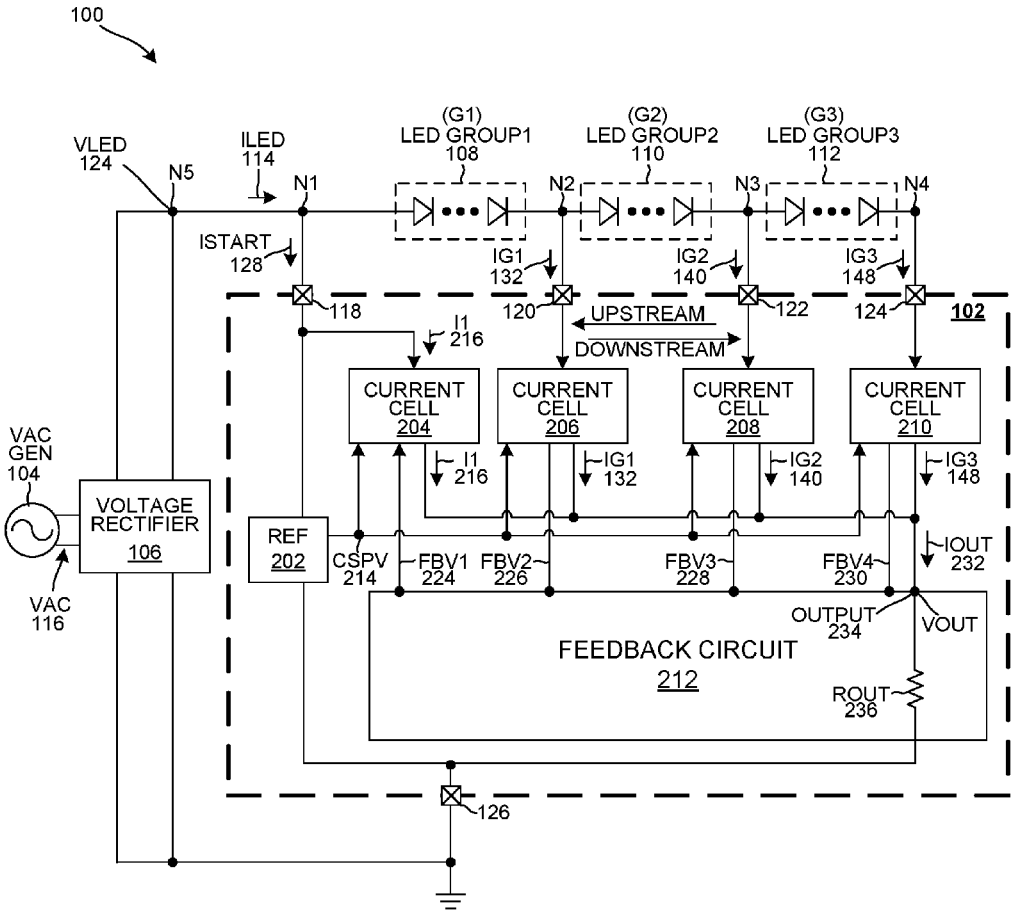
FIG. 2 shows an exemplary detailed block diagram of the multi-stage LED driver shown in FIG. 1.

FIG. 2 shows a detailed block diagram of the multi-stage LED driver 102 shown in FIG. 1. The multi-stage LED driver 102 comprises a reference circuit 202, a first current cell 204, a second current cell 206, a third current cell 208, a fourth current cell 210, and a feedback circuit 212. In an exemplary embodiment, current cells to the right of a particular current cell are designated as "downstream" current cells, and current cells to the left of a particular current cell are designated as "upstream" current cells. The reference 202 supplies each of the current cells with a current setpoint voltage (CSPV) 214. The feedback circuit 212 outputs feedback voltages FBV1 224, FBV2 226, FBV3 228 and FBV4 230 to the current cells.

In an exemplary embodiment, when the VAC 116 voltage is applied, the generated VLED 124 signal at node N1 is received at the first current cell 204 and the reference 202. A starting (or initial) current ISTART 128 comprises a first portion that flows to the reference 202 and a second portion (I1 216) that can flow to the first current cell 204. The CSPV 214 voltage and the FBV1 224 voltage are also received at the first current cell 204. When the received voltages meet selected conditions, the current cell 204 is enabled to regulate current flow from the terminal 118 to the output node 234. For example, when the current cell 204 is enabled to regulate current, the current I1 216 flows through the current cell 204 to the output node 234.

The second current cell 206 receives the voltage at node N2, the CSPV 214 voltage, and the FBV2 226 voltage. Based on these voltages, the current cell 206 is enabled to regulate current flow from the node N2 to the output node 234. For example, when the current cell 206 is enabled, a current IG1 132 flows through the current cell 206 to the output node 234. In an exemplary embodiment, the current ILED 114, which provides the ISTART current 128 and the IG1 current 132, is proportional to the input voltage VLED 124.

The third current cell 208 receives the voltage at node N3, the CSPV 214 voltage, and the FBV3 228 voltage. Based on these voltages, the current cell 208 regulates current flow from the node N3 to the output node 234. For example, when the current cell 208 is enabled, a current IG2 140 flows through the current cell 208 to the output node 234. In an exemplary embodiment, the current ILED 114, which provides the ISTART current 128, the IG1 current 132, and the IG2 current 140 is proportional to the input voltage VLED 124.

The fourth current cell 210 receives the voltage at node N4, the CSPV 214 voltage, and the FBV4 230 voltage. Based on these voltages, the current cell 210 regulates current flow from the node N4 to the output node 234. For example, when the current cell 210 is enabled, a current IG3 148 flows through the current cell 210 to the output node 234. In an exemplary embodiment, the current ILED 114, which provides the ISTART current 128, the IG1 current 132, the IG2 current 140, and the IG3 current 148, remains substantially proportional to the input voltage VLED 124.

The currents output from the current cells are combined to form a current IOUT 232 that flows into resistor ROUT 236. This results in an output voltage VOUT at the output node 234.

The feedback circuit 212 generates the feedback voltage input to each of the current cells. For example, the first current cell 204 generates a bias current that is input to the feedback circuit to generate the FBV1 224 signal. The first current cell 204 uses the FBV1 224 signal to determine when to enable, disable, and regulate current to flow through the cell. Thus, when enabled, the current cell 204 regulates current flow through the cell such that if possible FBV1 224 is made substantially equal to the CSPV 214.

The second 206 and third 208 current cells also generate bias currents that are input to the feedback circuit 212 to generate the second (FBV2) 226 and third (FBV3) 228 feedback voltages. The second 206 and third 208 current cells use the FBV2 226 and FBV3 228 to determine when to enable, disable, and regulate current to flow through these cells. Thus, when enabled, the current cells 206 and 208 regulate current flow through them such that if possible FBV2 226 and FBV3 228 are made substantially equal to the CSPV 214.

During operation, when each current cell enables current flow, the feedback circuit 212 adjusts the feedback voltage levels such that relative to the enabled current cell, upstream current cells see a slightly larger feedback voltage and are disabled. Thus, there is a small transition period when two cells are enabled, however, outside this transition period only one current cell is enabled at a time. A more detailed description of the operation of the LED driver circuit 102 is provided below.

Figure 3:
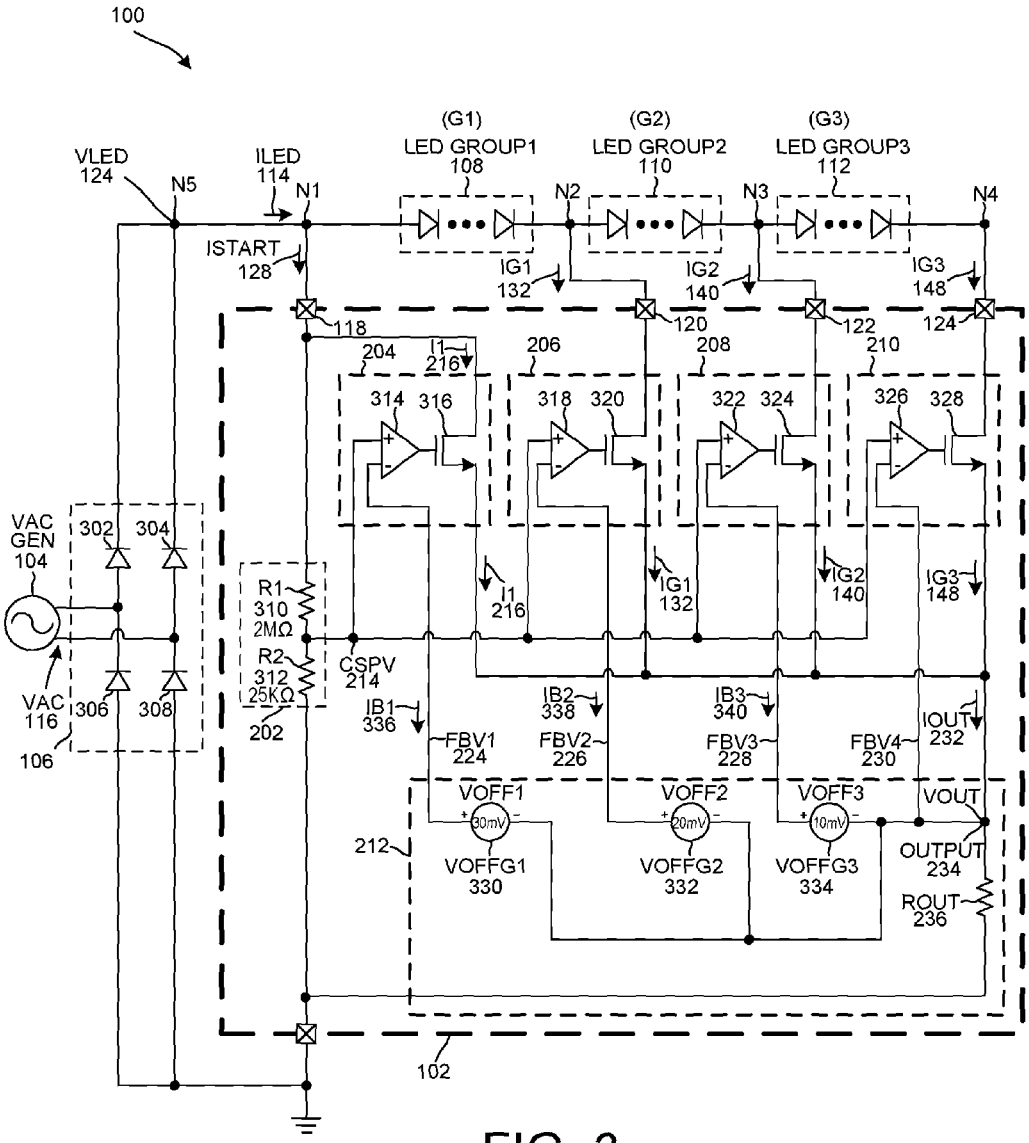
FIG. 3 shows an exemplary detailed circuit diagram of the system shown in FIG. 1.

FIG. 3 shows an exemplary detailed circuit diagram of the system 100 shown in FIG. 1.

In an exemplary embodiment, the voltage rectifier 106 comprises a first diode 302, a second diode 304, a third diode 306, and a fourth diode 308. The first diode 302 and the third diode 306 are coupled in series. The second diode 304 and the fourth diode 308 are coupled in series. The voltage rectifier 106 receives the VAC 116 voltage from the AC generator 104 and outputs a rectified voltage (VLED 124) onto node N5.

In an exemplary embodiment, the reference 202 comprises a resistor divider formed by resistor R1 310 and resistor R2 312. In one embodiment, resistor R1 310 has a resistance of 2 M Ohms and resistor R2 312 has a resistance of 25 k Ohms. The resistor divider receives the rectified voltage (VLED 124) output from the voltage rectifier 106 and outputs a divided down (or scaled) voltage referred to as the current setpoint voltage (CSPV) 214. The CSPV 214 voltage is supplied to noninverting inputs of amplifiers of each of the current cells 204, 206, 208, and 210.

Each of the current cells 204, 206, 208, and 210 includes an amplifier and a transistor. First current cell 204 comprises amplifier 314 and NMOS transistor 316. Second current cell 206 comprises amplifier 318 and NMOS transistor 320. Third current cell 208 comprises amplifier 322 and NMOS transistor 324. Fourth current cell 210 comprises amplifier 326 and NMOS transistor 328.

The feedback circuit 212 includes a first voltage offset generator (VOFFG1) 330 that generates a first offset voltage (VOFF1), a second voltage offset generator (VOFFG2) 332 that generates a second offset voltage (VOFF2), a third voltage offset generator (VOFFG3) 334 that generates a third offset voltage (VOFF3), and the resistance ROUT 236. In one embodiment, each of the voltage offset generators is realized as one or more resistances.

During operation, current cells 204, 206, and 208 generate bias currents that are used to generate the offset voltages (VOFF1, VOFF2, VOFF3) that are added to VOUT to generate the feedback voltages FBV1, FBV2, and FBV3. For example, the first current cell 204 generates the bias current IB1 336 that is used by VOFFG1 330 to generate the first feedback voltage FBV1 224 (VOFF1+VOUT). Likewise, the second and third current cells (206, 208) generate bias currents (IB2 338, IB3 340) that are used by the VOFFG2 332 and VOFFG3 334 to generate the feedback voltages FBV2 226 (VOFF2+VOUT) and FBV3 228 (VOFF3+VOUT). The fourth feedback voltage (FBV4 230) is substantially the same as the output voltage (VOUT) at output node 234.

The bias currents IB1, IB2, and IB3 are generated so that the corresponding feedback voltages will have slightly different voltage levels. In an exemplary embodiment, VOFF1 is 30 millivolts, VOFF2 is 20 millivolts, and VOFF3 is 10 millivolts. Therefore, the feedback circuit 212 generates a plurality of feedback voltages from a voltage level (VOUT) at the output resistor 236, and when a selected current cell is enabled by its respective feedback voltage to regulate a selected current level from its respective input to the output resistor, upstream current cells are disabled by their respective feedback voltages. As will be shown in greater detail below, the voltage level differences of the feedback voltages operate to enable and disable the current cells to provide power efficiency with reduced distortion.

Figure 4:
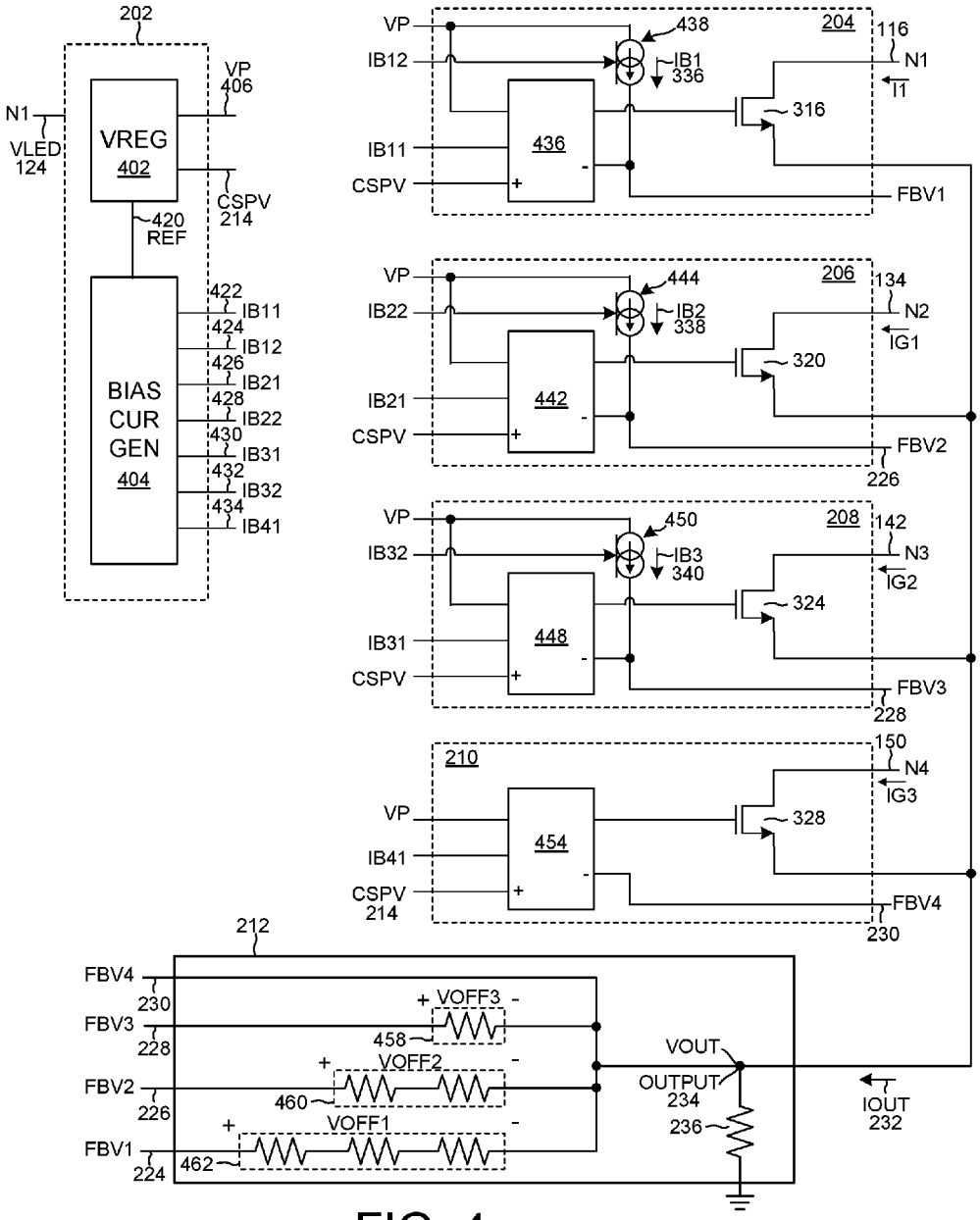
FIG. 4 shows an exemplary embodiment of the multi-stage LED driver shown in FIG. 1.

FIG. 4 shows an exemplary embodiment of the multi-stage LED driver shown in FIG. 1.

Reference 202 comprises a voltage regulator 402 and a bias current generator 404. The reference 202 receives the LED drive signal VLED 124 at node N1. The voltage regulator 402 generates and supplies a positive voltage (VP) 406 and the CSPV 214 onto each of the current cells. In an exemplary embodiment, the VP 406 signal is approximately 6.5 volts and the CSPV 214 signal is a scaled version of the VLED 124 signal generated by the resistor divider formed by R1 and R2, which is within the reference 202. The regulator 402 also generates a reference signal 420 that is input to the bias current generator 404.

Bias current generator 404 receives the reference signal 420 and generates a plurality of fixed bias currents. In an exemplary embodiment, the bias current generator 404 generates and supplies bias currents IB11 and IB12 to current cell 204 via nodes 422 and 424, respectively. Bias current generator 404 generates and supplies bias currents IB21 and IB22 to current cell 206 via nodes 426 and 428, respectively. Bias current generator 404 generates and supplies bias currents IB31 and IB32 to current cell 208 via nodes 430 and 432, respectively. Bias current generator 404 generates and supplies bias current IB41 to current cell 210 via node 434. In an exemplary embodiment, the generated bias current are used to tune the operation of the current cells in accordance with the exemplary embodiments.

The current cell 204 includes amplifier 436, configurable current generator 438, and transistor 316. The amplifier 436 includes the amplifier 314 and any other desired biasing circuitry. In an exemplary embodiment, the amplifier 314 is implemented as a differential amplifier within the amplifier 436. The current cell 204 receives supply voltage VP via node 406, bias current IB12 via node 424, bias current IB11 via node 422, and CSPV via node 214. The bias current IB12 causes configurable current generator 438 to output a bias current IB1 336 to feedback circuit 212. The feedback circuit 212 uses the bias current IB1 336 to generate the feedback voltage FBV1 224. Amplifier 436 amplifies the difference between the feedback voltage FBV1 and the CSPV. When a voltage level of CSPV exceeds the feedback voltage FBV1, an output of the amplifier 436 enables transistor 316 causing current I1 to flow from node N1 to the output node 234.

The current cell 206 includes amplifier 442, configurable current generator 444, and transistor 320. The amplifier 442 includes the amplifier 318 and any other desired biasing circuitry. In an exemplary embodiment, the amplifier 318 is implemented as a differential amplifier within the amplifier 442. The current cell 206 receives supply voltage VP via node 416, bias current IB22 via node 428, bias current IB21 via node 426, and CSPV via node 214. The bias current IB22 causes configurable current generator 444 to output bias current IB2 338 to feedback circuit 212. The feedback circuit uses the bias current IB2 338 to generate the feedback voltage FBV2 onto node 226. Amplifier 442 amplifies the difference between the feedback voltage FBV2 and the CSPV. When a voltage level of CSPV exceeds the feedback voltage FBV2, an output of the amplifier 442 enables transistor 320 causing current IG1 to flow from node N2 to the output node 234.

The current cell 208 includes amplifier 448, configurable current generator 450, and transistor 324. The amplifier 448 includes the amplifier 322 and any other desired biasing circuitry. In an exemplary embodiment, the amplifier 322 is implemented as a differential amplifier within the amplifier 448. The current cell 208 receives supply voltage VP via node 406, bias current IB32 via node 432, bias current IB31 via node 430, and CSPV via node 214. The bias current IB32 causes configurable current generator 450 to output bias current IB3 340 to feedback circuit 212. The feedback circuit uses the bias current IB3 340 to generate the feedback voltage FBV3 onto node 228. Amplifier 448 amplifies the difference between the feedback voltage FBV3 and the CSPV. When a voltage level of CSPV exceeds the feedback voltage FBV3, an output of the amplifier 448 enables transistor 324 causing current IG2 to flow from node N3 to the output node 234.

The current cell 210 includes amplifier 454 and transistor 328. The amplifier 454 includes the amplifier 326 and any other desired biasing circuitry. In an exemplary embodiment, the amplifier 326 is implemented as a differential amplifier within the amplifier 454. The current cell 210 receives supply voltage VP via node 406, bias current IB41 via node 434, and CSPV via node 214. Amplifier 454 amplifies the difference between the feedback voltage FBV4 and the CSPV. When a voltage level of CSPV exceeds the feedback voltage FBV4, an output of the amplifier 454 enables transistor 328 causing current IG3 to flow from node N4 to the output node 234.

Feedback circuit 212 comprises resistances 236, 458, 460, and 462. In an exemplary embodiment, the resistance 458 forms the offset generator VOFFG3 334, the resistance 460 forms the offset generator VOFFG2 332, and the resistance 462 forms the offset generator VOFFG1 330. Resistance 236 is coupled directly between the output node 234 and ground. Feedback circuit 212 outputs feedback voltage FBV4 via node 230, which is equivalent to the VOUT voltage at output node 234. Feedback circuit 212 receives the bias current IB3 340, which is supplied to resistance 458 to generate VOFF3 and thus generates the feedback voltage FBV3 via node 228 as the sum of VOUT and VOFF3. Feedback circuit 212 receives the bias current IB2 338, which is supplied to resistance 460 to generate VOFF2 and thus generates the feedback voltage FBV2 via node 226 as the sum of VOUT and VOFF2. Feedback circuit 212 receives the bias current IB1 336, which is supplied to resistance 462 to generate VOFF1 and thus generates the feedback voltage FBV1 via node 224 as the sum of VOUT and VOFF1.

During operation, the bias currents IB1, IB2 and IB3 combine with the resistances 462, 460, and 458 to generate offsets and corresponding feedback voltages FBV1, FBV2, and FBV3 that have voltage levels that enable/disable the current cells in a sequential fashion as the input voltage level changes.

Figure 5:
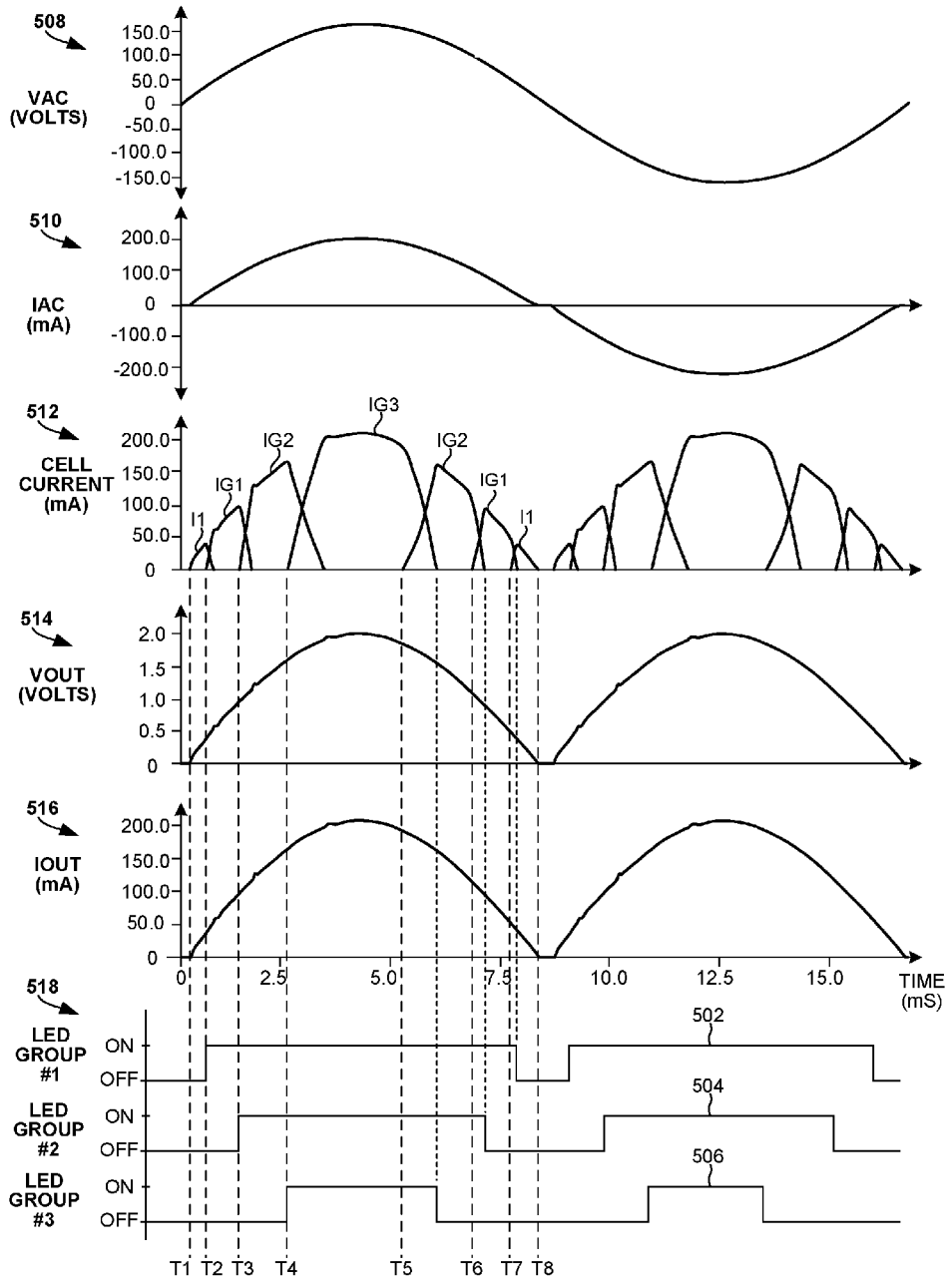
FIG. 5 shows waveform diagrams along various nodes of system as illustrated in FIG. 3.

FIG. 5 shows waveform diagrams along various nodes of system 100 as illustrated in FIG. 3. The graph 508 shows the VAC waveform illustrating the voltage at the output of the AC source 104.

The graph 510 shows the IAC waveform illustrating the current at the output of the AC source 104. As can be seen by the graphs 508 and 510, the current IAC is proportional and linear with respect to VAC, which results in low harmonic distortion and improved power factor over conventional systems.

The graph 512 shows cell current waveforms illustrating current through the various current cells. At time T1, the input voltage at terminal 118 (node N1) begins to increase and the CSPV 214 is generated. Based on the CSPV 214, FBV1 224 and the input voltage at terminal 118 (node N1), the first current cell 204 begins to turn on and conduct the current I1 216 to the output node 234. None of the LED groups are energized between time T1 and time T2. As the I1 current flow increases, the output voltage (VOUT) increases and the level of the generated feedback voltages also increases.

At time T2, based on the CSPV 214, FBV2 226 and the voltage at terminal 120 (node N2), the second current cell 206 begins to turn on and conduct the current IG1 132 to the output node 234. The current IG1 132 energizes the LED G1 108 to emit light. LED group #2 110 and LED group #3 112 are off between time T2 and time T3. As the current level of IG1 132 increases, the output voltage (VOUT) also increases. This results in an increase in the generated feedback voltages such that FBV1 increases to a level that disables the first current cell 204. Thus, as illustrated in the graph 512 of the cell currents, as the current IG1 begins to increase, the current I1 begins to decrease as the current cell 204 is disabled by the increasing feedback voltage FBV1 224.

At time T3, based on the CSPV 214, FBV3 228 and the voltage at terminal 122 (node N3), the third current cell 208 begins to turn on and conduct the current IG2 140 to the output node 234. The current IG2 140 energizes the LED G2 110 to emit light. Thus, LED groups #1 and #2 are energized and LED group #3 112 is off between time T3 and time T4. As the current level of IG2 140 increases, the output voltage (VOUT) also increases. This results in an increase in the generated feedback voltages such that FBV2 226 increases to a level that disables the second cell 206. Thus, as illustrated in the graph 512 of the cell currents, as the current IG2 begins to increase, the current IG1 begins to decrease as the current cell 206 is disabled by the increasing feedback voltage FBV2 226.

At time T4, based on the CSPV 214, FBV4 230 and the voltage at terminal 124 (node N4), the fourth current cell 210 begins to turn on and conduct the current IG3 148 to the output node 234. The current IG3 148 energizes the LED G3 112 to emit light. Thus, LED groups #1, #2, and #3 are energized to emit light. As the current level of IG3 148 increases, the output voltage (VOUT) also increases. This results in an increase in the generated feedback voltages such that FBV3 228 increases to a level that disables the third current cell 208. Thus, as illustrated in the graph 512 of the cell currents, as the current IG3 begins to increase, the current IG2 begins to decrease as the current cell 208 is disabled by the increasing feedback voltage FBV3 228.

At a time between times T4 and T5, the rectified input voltage enters a decreasing phase where the current IG3 148 begins to decline and the feedback voltage FBV3 also declines.

At time T5, based on the voltage at terminal 122 (node N3), the CSPV 214, and the decreasing FBV3 228, the third current cell 208 begins to turn on and conduct the current IG2 140 to the output node 234, while the current IG3 148 continues to decrease. Thus, as illustrated in the graph 512 of the cell currents, the current IG2 begins to increase, the current IG3 begins to decrease as the current cell 210 is disabled by the decreasing voltage at node N4 until a point is reached where IG3 approaches zero and LED group 3 is turned off.

At time T6, based on the voltage at terminal 120 (node N2), the CSPV 214, and the decreasing FBV2 226, the second current cell 206 begins to turn on and conduct the current IG1 132 to the output node 234, while the current IG2 140 continues to decrease. Thus, as illustrated in the graph 512 of the cell currents, the current IG1 begins to increase and the current IG2 begins to decrease as the current cell 208 is disabled by the decreasing voltage at node N3 until a point is reached where IG2 approaches zero and LED group 2 is turned off.

At time T7, based on the voltage at terminal 118 (node N1), the CSPV 214 and the decreasing FBV1 224, the first current cell 204 begins to turn on and conduct the current I1 216 to the output node 234, while the current IG1 132 continues to decrease. Thus, as illustrated in the graph 512 of the cell currents, the current I1 begins to increase and the current IG1 begins to decrease as the current cell 206 is disabled by the decreasing voltage at node N2 until a point is reached where IG1 approaches zero and LED group 1 is turned off.

At time T8, the input voltage at terminal 118 (node N1) decreases to a level that results in the first current cell 204 being disabled and the current I1 decreasing to zero.

The graph 514 shows a VOUT waveform illustrating the voltage at node VOUT 234. The graph 516 shows an IOUT waveform illustrating the current at node IOUT 232. The graph 518 shows waveform 502 illustrating the on/off state of LED group #1 108, waveform 504 illustrating the on/off state of LED group #2 110, and waveform 506 illustrating the on/off state of LED group #3 112.

Figure 6:
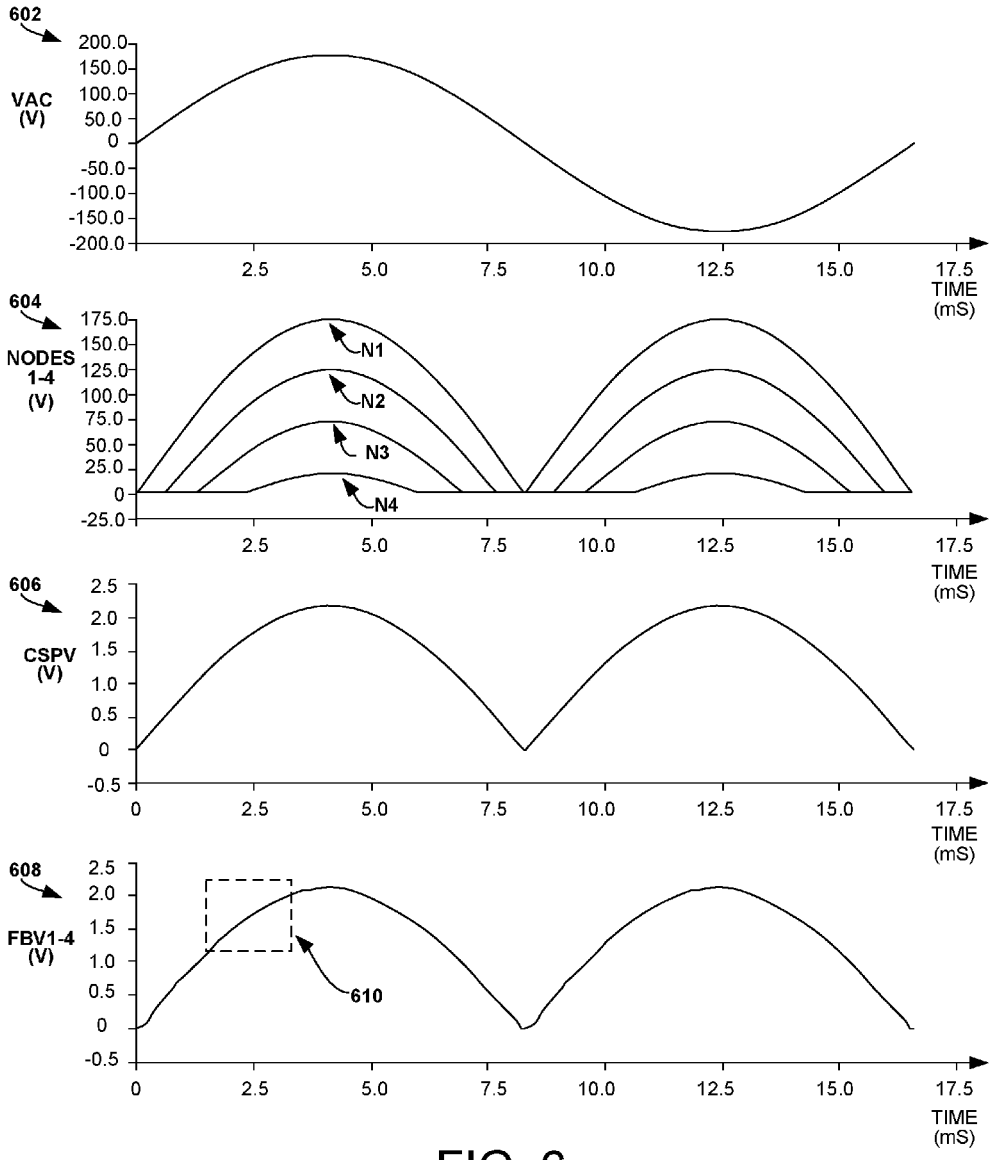
FIG. 6 shows waveform diagrams along various nodes of system as illustrated in FIG. 3.

FIG. 6 shows waveform diagrams along various nodes of system 100 as illustrated in FIG. 3. A first graph 602 illustrates a waveform diagram of a full cycle of the AC input voltage 116 received at the input of the rectifier 106. A second graph 604 illustrates voltage waveform diagrams at nodes N1-N4. For example, the AC input signal 116 is rectified by the rectifier 106 to generate a rectified LED drive signal that appears at node N1. A voltage drop across each LED group results in the voltage waveform diagrams indicated for node N2, N3, and N4, as shown in graph 604.

A third graph 606 illustrates a waveform diagram for the current setpoint voltage 214. The CSPV 214 is a scaled version of the LED drive signal that appears at node N1. In an exemplary embodiment, the CSPV 214 is generated by a resistor divider network that scales the voltage at node N1 to have a maximum voltage level of approximately two volts.

A fourth graph 608 illustrates waveform diagrams for the feedback voltages FBV1, FBV2, FBV3, and FBV4. In an exemplary embodiment, the feedback voltages are generated by adding offset voltages to the VOUT voltage at output node 234. For example, a waveform diagram of the VOUT voltage is shown in FIG. 5. The waveform diagram in the graph 608 shows a single line for all four feedback voltages; however, the voltages are separated by approximately 10 mV. To illustrate the small differences between the feedback voltages, an expanded view of the region 610 is shown in FIG. 7.

Figure 7:
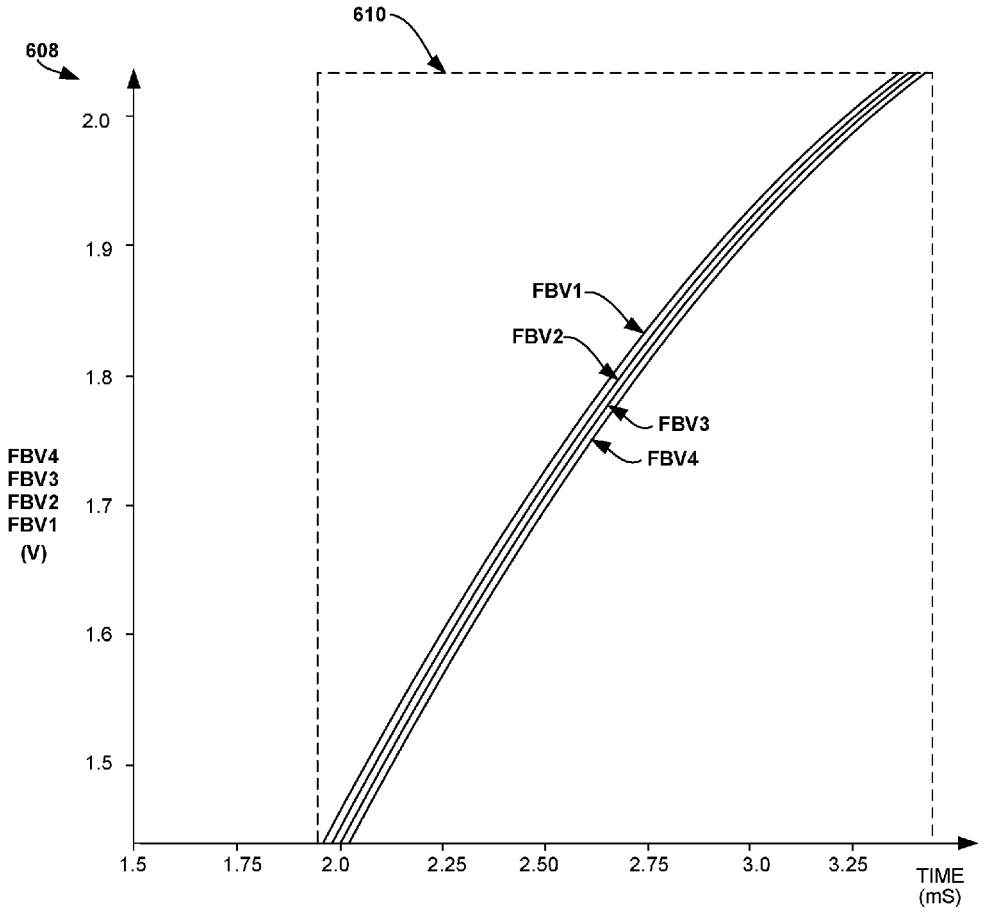
FIG. 7 shows waveform diagrams along various nodes of system as illustrated in FIG. 3.

FIG. 7 shows an expanded view of the graph 608 shown in FIG. 6 that illustrates waveform diagrams in the region 610. As illustrated in FIG. 7, at any point in time, the FBV4 signal has the lowest voltage level. In an exemplary embodiment, the FBV4 signal is equal to the voltage VOUT at the output node 234. As illustrated in FIG. 7, the FBV3 signal is ten (10) millivolts greater than the FBV4. In an exemplary embodiment, the offset generator 458 shown in FIG. 4 increases the FBV3 signal to be 10 mV greater than the FBV4 signal.

FIG. 7 also shows that the FBV2 signal is 10 mV greater than the FBV3 signal and therefore 20 mV greater than the FBV4 signal. In an exemplary embodiment, the offset generator 460 shown in FIG. 4 increases the FBV2 signal to be 10 mV greater than the FBV3 signal. FIG. 7 also shows that the FBV1 signal is 10 mV greater than the FBV2 signal and therefore 30 mV greater than the FBV4 signal. In an exemplary embodiment, the offset generator 462 shown in FIG. 4 increases the FBV1 signal to be 10 mV greater than the FBV2 signal.

Figure 8:
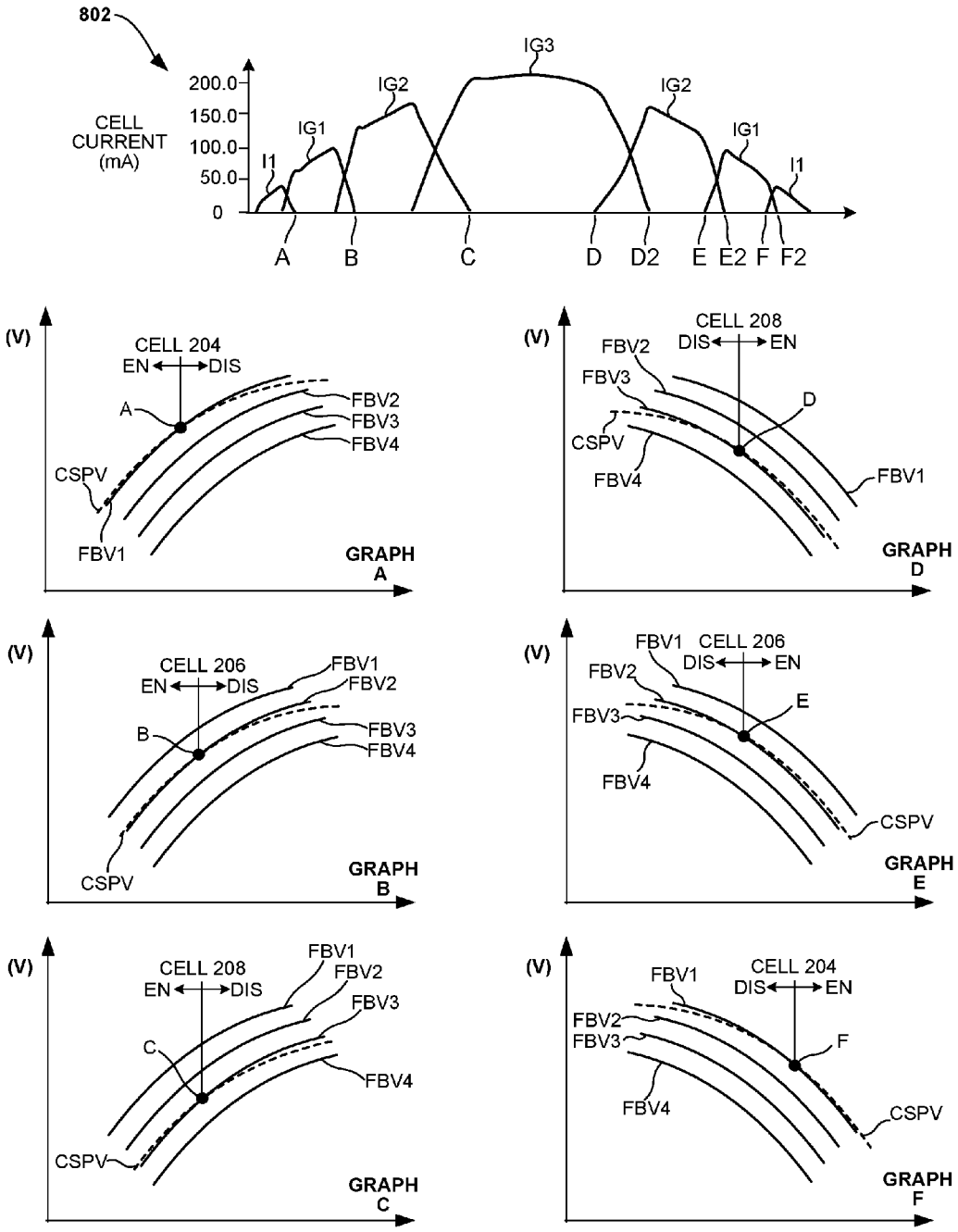
FIG. 8 shows waveform diagrams that illustrate how generated feedback voltages are used to enable and disable current cells in the system as illustrated in FIG. 3.

FIG. 8 shows waveform diagrams that illustrate how generated feedback voltages are used to enable and disable current cells in the system 100. A graph 802 shows a waveform diagram of cell currents generated over one half cycle of the AC input voltage. As illustrated in the graph 802, as the input voltage increases the current cells 204-210 are sequentially enabled and regulate the currents I1, IG1, IG2, and IG3 to increase current flow to the output node 234, and then as the input voltage decreases the current cells are sequentially disabled and regulate the currents IG3, IG2, IG1 and I1 to decrease current flow to the output node 234.

During operation, the feedback voltages (FBV1, FBV2, FBV3, and FBV4) adjust with the VOUT voltage at the output node 234 so that the differences between the feedback voltages and the CSPV 214 can be used to enable and disable the current cells. For example, referring to the graph 802, as the input voltage increases, the current cell 204 is enabled to regulate the current I1 to the output node 234. As the input voltage continues to increase, the current cell 206 begins to output the current IG1 to the output node 234. As the current IG1 increases, the current cell 204 reduces its regulated output current to maintain FBV1 224 equal to CSPV 214. When the current cell 204 outputs zero current at point A, the current cell 204 is disabled and FBV1 224 becomes greater than CSPV 214.

Graph A shows the feedback waveforms (FBV1-4) and the CSPV 214 waveform and illustrates how current cell 204 is disabled at point A. Prior to point A, the current cell 204 is enabled (EN) and the FBV1 224 has a voltage level that is very close to CSPV 214. The amplifier 314 drives transistor 316 on to try to minimize the difference between FBV1 224 and CSPV 214. As the VOUT level increases, due to the increasing IG1 current, the feedback voltage levels increase. At point A, the FBV1 224 is approximately equal to the CSPV 214 and after this time, the FBV1 224 is greater than the CSPV 214. When the FBV1 224 is greater than the CSPV 214, the output of the amplifier 314 turns off the transistor 316, which disables (DIS) the current cell 204. Thus, as the input voltage increases and the current cell 206 sources more current (IG1) to the output node 234, the upstream current cell (e.g., current cell 204) is disabled due to the increase in the feedback voltage FBV1 224.

Referring again to the graph 802, as the input voltage continues to increase from point A, the current cell 208 begins to output the current IG2 to the output node 234. As the current IG2 increases, the current cell 206 reduces its regulated output current to maintain FBV2 226 equal to CSPV 214. When the current cell 206 outputs zero current at point B, the current cell 206 is disabled and FBV2 226 becomes greater than CSPV 214.

Graph B shows the feedback waveforms (FBV1-4) and the CSPV 214 waveform and illustrates how current cell 206 is disabled at point B. Prior to point B, the current cell 206 is enabled (EN) and the FBV2 226 has a voltage level that is very close to CSPV 214. The amplifier 318 drives transistor 320 on to try to minimize the difference between FBV2 226 and CSPV 214. As the VOUT level increases, due to the increasing IG2 current, the feedback voltage levels increase. At point B, the FBV2 226 is approximately equal to the CSPV 214 and after this time, the FBV2 226 is greater than the CSPV 214. When the FBV2 226 is greater than the CSPV 214, the output of the amplifier 318 turns off the transistor 320, which disables (DIS) the current cell 206. Thus, as the input voltage increases and the current cell 208 outputs more current (IG2) to the output node 234, the upstream current cell (e.g., current cell 206) is disabled due to the increase in the feedback voltage FBV2 226.

Referring again to the graph 802, as the input voltage continues to increase from point B, the current cell 210 begins to output the current IG3 to the output node 234. As the current IG3 increases, the current cell 208 reduces its regulated output current to maintain FBV3 228 equal to CSPV 214. When the current cell 208 outputs zero current at point C, the current cell 208 is disabled and FBV3 228 becomes greater than CSPV 214.

Graph C shows the feedback waveforms (FBV1-4) and the CSPV 214 waveform and illustrates how current cell 208 is disabled at point C. Prior to point C, the current cell 208 is enabled and the FBV3 228 has a voltage level that is very close to CSPV 214. The amplifier 322 drives transistor 324 on to try to minimize the difference between FBV3 228 and CSPV 214. As the VOUT level increases, due to the increasing IG3 current, the feedback voltage levels increase. At point C, the FBV3 228 is approximately equal to the CSPV 214 and after this time, the FBV3 228 is greater than the CSPV 214. When the FBV3 228 is greater than the CSPV 214, the output of the amplifier 322 turns off the transistor 324, which disables (DIS) the current cell 208. Thus, as the input voltage increases and the current cell 210 outputs more current (IG3) to the output node 234, the upstream current cell (e.g., current cell 208) is disabled due to the increase in the feedback voltage FBV3 228.

Referring to the graph 802, as the input voltage begins to decrease, the current IG3 output by the current cell 210 begins to decrease. As the current IG3 decreases, the voltage level of VOUT at the output node 234 decreases and the FBV3 228 voltage also decreases. At point D, the CSPV 214 voltage becomes slightly greater than the FBV3 228 voltage and the amplifier 322 drives transistor 324 on to try to minimize the difference between FBV3 228 and CSPV 214. Thus, the upstream current cell (e.g., current cell 208) is enabled as the input voltage decreases. As the input voltage continues to decrease, the current IG3 decreases while the enabled upstream current cell 208 increases its regulated output current IG2 to minimize the difference between FBV3 228 and CSPV 214.

Graph D shows the feedback waveforms (FBV1-4) and the CSPV 214 waveform and illustrates how current cell 208 is enabled at point D. Prior to point D, the FBV3 228 has a higher voltage level than the CSPV 214 and the current cell 208 is disabled (DIS). As the VOUT level decreases, the feedback voltage levels decrease due to the decreasing IG3 current. At point D, the CSPV 214 level becomes slightly greater than the FBV3 228 level. At this point, the output of the amplifier 322 turns on the transistor 324, which enables (EN) the current cell 208 to regulate the current IG2 to the output node 234 to minimize the difference between FBV3 228 and CSPV 214. Thus, as the input voltage decreases and the current cell 210 outputs less IG3 current to the output node 234, the upstream current cell (e.g., current cell 208) is enabled (due to the decrease in the feedback voltage FBV3 228) to output the current IG2 to the output node 234. Eventually, the input voltage decreases enough so that the current cell 210 decreases the IG3 current to zero at point D2, while the current cell 208 continues to regulate the IG2 current to the output node 234.

Referring again to the graph 802, as the input voltage continues to decrease after point D2, the regulated current IG2 output by the current cell 208 begins to decrease. As the current IG2 decreases, the voltage level of VOUT at the output node 234 decreases and the FBV2 226 voltage also decreases. At point E, the CSPV 214 voltage becomes slightly greater than the FBV2 226 voltage and the amplifier 318 drives transistor 320 on to try to minimize the difference between FBV2 226 and CSPV 214. Thus, the upstream current cell (e.g., current cell 206) is enabled as the input voltage decreases. As the input voltage continues to decrease, the current IG2 decreases while the enabled upstream current cell 206 increases its regulated output current IG1 to minimize the difference between FBV2 226 and CSPV 214.

Graph E shows the feedback waveforms (FBV1-4) and the CSPV 214 waveform and illustrates how current cell 206 is enabled at point E. Prior to point E, the FBV2 226 has a higher voltage level than the CSPV 214 and the current cell 206 is disabled (DIS). As the VOUT level decreases, the feedback voltage levels decrease due to the decreasing IG2 current. At point E, the CSPV 214 level becomes slightly greater than the FBV2 226 level. At this point, the output of the amplifier 318 turns on the transistor 320, which enables (EN) the current cell 206 to regulate the current IG1 to the output node 234 to minimize the difference between FBV2 226 and CSPV 214. Thus, as the input voltage decreases and the current cell 208 outputs less IG2 current to the output node 234, the upstream current cell (e.g., current cell 206) is enabled (due to the decrease in the feedback voltage FBV2 226) to output the current IG1 to the output node 234. Eventually, the input voltage decreases enough so that the current cell 208 decreases the IG2 current to zero at point E2 (see graph 802) while the current cell 206 continues to regulate the IG1 current to the output node 234.

Referring again to the graph 802, as the input voltage continues to decrease after point E2, the regulated current IG1 output by the current cell 206 begins to decrease. As the current IG1 decreases, the voltage level of VOUT at the output node 234 decreases and the FBV1 224 voltage also decreases. At point F, the CSPV 214 voltage becomes slightly greater than the FBV1 224 voltage and the amplifier 314 drives transistor 316 on to try to minimize the difference between FBV1 224 and CSPV 214. Thus, the upstream current cell (e.g., current cell 204) is enabled as the input voltage decreases. As the input voltage continues to decrease, the current IG1 decreases while the enabled upstream current cell 204 increases its regulated output current I1 to minimize the difference between FBV1 224 and CSPV 214.

Graph F shows the feedback waveforms (FBV1-4) and the CSPV 214 waveform and illustrates how current cell 204 is enabled at point F. Prior to point F, the FBV1 224 has a higher voltage level than the CSPV 214 and the current cell 204 is disabled (DIS). As the VOUT level decreases, the feedback voltage levels decrease due to the decreasing IG1 current. At point F, the CSPV 214 level becomes slightly greater than the FBV1 224 level. At this point, the output of the amplifier 314 turns on the transistor 316, which enables (EN) the current cell 204 to regulate the current I1 to the output node 234 to minimize the difference between FBV1 224 and CSPV 214. Thus, as the input voltage decreases and the current cell 206 outputs less IG1 current to the output node 234, the upstream current cell (e.g., current cell 204) is enabled (due to the decrease in the feedback voltage FBV1 224) to output the current I1 to the output node 234. Eventually, the input voltage decreases enough so that the current cell 206 decreases the IG1 current to zero at point F2 while the current cell 204 continues to regulate the I1 current to the output node 234. Eventually, the input voltage goes to zero and the I1 current also goes to zero.

Therefore, the varying relationships between the CSPV and the feedback voltages are used to disable upstream current cells as the input voltage increases and to enable upstream current cells as the input voltage decreases.

Figure 9:
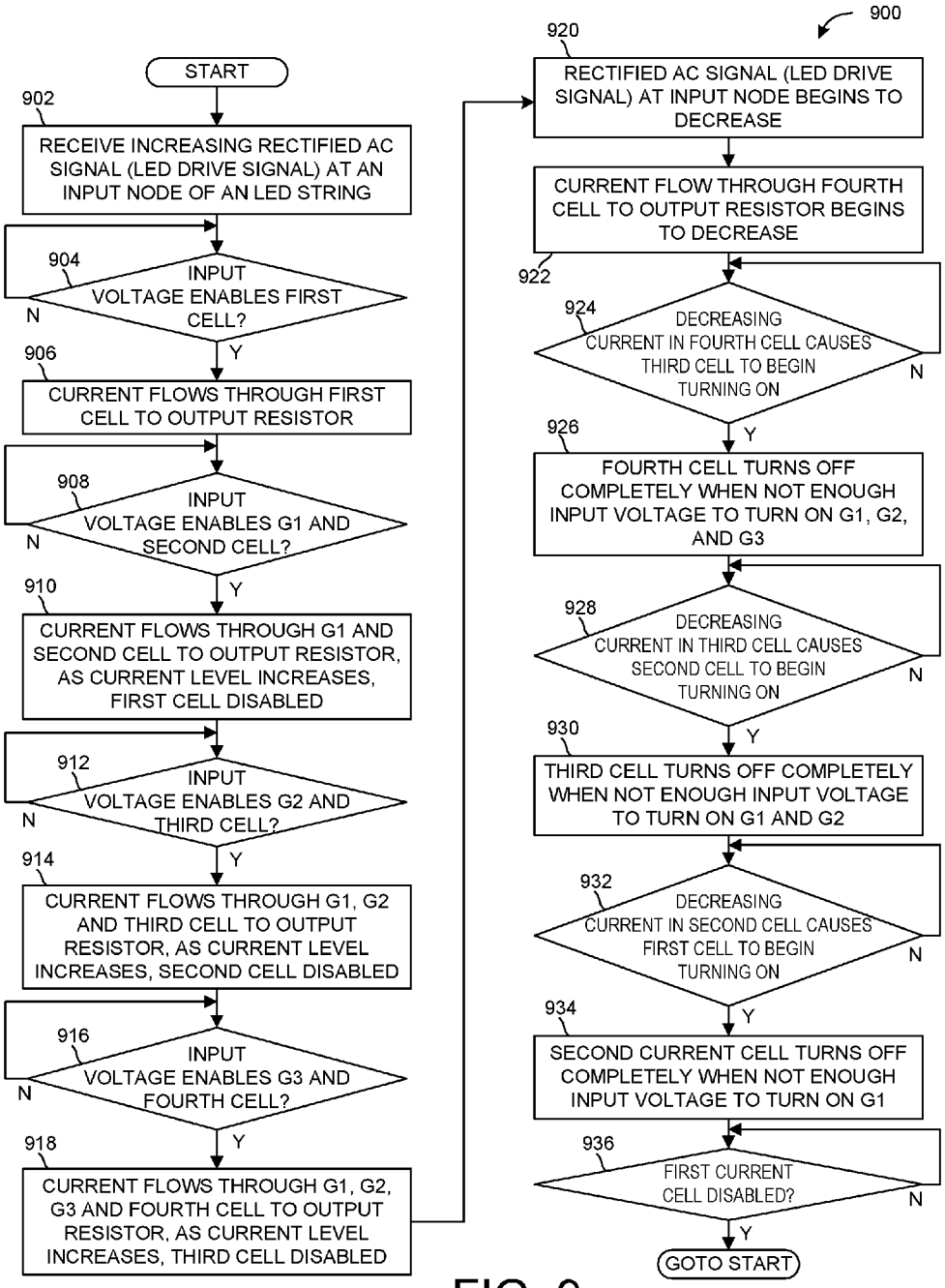
FIG. 9 shows a flowchart of a method in accordance with one novel aspect.

FIG. 9 is a flowchart of a method 900 in accordance with one novel aspect. In an exemplary embodiment, the method 900 is suitable for use with the LED driver 102 shown in FIG. 3 to efficiently drive multiple LED groups in an LED bulb or other lighting device.

At block 902, a rectified AC signal is received at an input node of an LED string. For example, the rectifier 106 outputs the rectified signal VLED 124 that is input to the node N1 at the input of the LED string that comprises three groups of LEDS (e.g., G1, G2, G3). For example, the signal VLED 124 is a rectified version of the VAC signal 116.

At block 904, a determination is made as to whether the received rectified input voltage is large enough to enable a first current cell. For example, the rectified input voltage VLED 124 is received at terminal 118 of the LED driver 102 and is applied to the reference 202 and the first current cell 204. In an exemplary embodiment, the amplifier 314 of the first current cell 204 amplifies the difference between CSPV 214 and FBV1 224 and outputs the result to drive the gate of the transistor 316. If the voltage at terminal 118 is not large enough to cause the transistor 316 to turn on, the method returns to block 904. If the voltage at terminal 118 is large enough to cause the transistor 316 to turn on, the method proceeds to block 906.

At block 906, current flows through the first cell to an output resistor. For example, the current I1 216 flows through the transistor 316 of the current cell 204 on a signal path that leads to the output resistor (ROUT) 236, which in turn, generates a voltage (VOUT) at the output node 234.

At block 908, a determination is made as to whether the input voltage is large enough to enable a second current cell. For example, the voltage received at terminal 120 is applied to the drain of transistor 320 of current cell 206. In an exemplary embodiment, the amplifier 318 of the second current cell 206 amplifies the difference between CSPV 214 and FBV2 226 and outputs the result to drive the gate of the transistor 320. If the voltage at terminal 120 is not large enough to cause the current IG1 to flow through the transistor 320, the method returns to block 908. If the voltage at terminal 120 is large enough to cause the current IG1 to flow through the transistor 320, the method proceeds to block 910.

At block 910, current flows through G1 and the second cell to the output resistor. As the current level increases the first cell is disabled. In an exemplary embodiment, when the current cell 206 is enabled, the current IG1 flows through the transistor 320 to the output resistor 236. This results in a rise in the output voltage VOUT and a corresponding rise in the voltage level of FBV1 224. When FBV1 224 reaches a certain voltage level with respect to CSPV 214, the transistor 316 of first current cell 204 will be disabled and thus prevent the current I1 from flowing to the output resistor 236. For example, graph A of FIG. 8 illustrates how the upstream current cell 204 is disabled.

At block 912, a determination is made as to whether the input voltage is large enough to enable a third current cell. For example, the voltage received at terminal 122 is applied to the drain of transistor 324 of current cell 208. In an exemplary embodiment, the amplifier 322 of the third current cell 208 amplifies the difference between CSPV 214 and FBV3 228 and outputs the result to drive the gate of the transistor 324. If the voltage at terminal 122 exceeds the voltage VOUT, the current IG2 140 will flow through the transistor 324 to the output resistor ROUT 236. If the voltage at terminal 122 is not large enough to cause the current IG2 to flow through the transistor 324, the method returns to block 912. If the voltage at terminal 122 is large enough to cause the current IG2 to flow through the transistor 324, the method proceeds to block 914.

At block 914, current flows through G1, G2, and the third cell to the output resistor. As the current level increases the second current cell 206 is disabled. In an exemplary embodiment, when the current cell 208 is enabled, the current IG2 flows through the transistor 324 to the output resistor 236. This results in a rise in the output voltage VOUT and a corresponding rise in the voltage level of FBV2 226. When FBV2 226 reaches a certain level with respect to CSPV 214, the transistor 320 of second current cell 206 will be disabled and thus prevents the current IG1 from flowing to the output resistor. For example, graph B of FIG. 8 illustrates how the upstream current cell 206 is disabled.

At block 916, a determination is made as to whether the input voltage is large enough to enable a fourth current cell. For example, the voltage received at terminal 124 is applied to the drain of transistor 328 of current cell 210. In an exemplary embodiment, the amplifier 326 of the fourth current cell 210 amplifies the difference between CSPV 214 and FBV4 230 and outputs the result to drive the gate of the transistor 328. If the voltage at terminal 124 exceeds the voltage VOUT, the current IG3 148 will flow through the transistor 328 to the output resistor ROUT 236. If the voltage at terminal 124 is not large enough to cause the current IG3 to flow through the transistor 328, the method returns to block 916. If the voltage at terminal 124 is large enough to cause the current IG3 to flow through the transistor 328, the method proceeds to block 918.

At block 918, current flows through G1, G2, G3 and the fourth cell to the output resistor. As the current level increases the third cell 208 is disabled. In an exemplary embodiment, when the current cell 210 is enabled, the current IG3 flows through the transistor 328 to the output resistor 236. This results in a rise in the output voltage VOUT and a corresponding rise in the voltage level of FBV3 228. When FBV3 228 reaches a certain level with respect to CSPV 214, the transistor 324 of third current cell 208 will be disabled and thus prevents the current IG2 from flowing to the output resistor. For example, graph C of FIG. 8 illustrates how the upstream current cell 208 is disabled.

At block 920, the rectified AC signal received at an input node of an LED string begins to decrease. For example, the voltage level of the VLED 124 input to the node N1 at the input of the LED string begins to decrease.

At block 922, current flow through the fourth cell begins to decrease as the input voltage decreases. For example, the voltage level at terminal 124 begins to decrease with the decreasing input voltage, thereby resulting in a decrease in the current IG3.

At block 924, a determination is made as to whether (due to the decreasing input voltage) the current in the fourth cell has decreased enough to cause the third cell to begin to turn on. In an exemplary embodiment, as the current level of IG3 decreases the voltage level at VOUT also decreases. This results in a corresponding decrease of the level of FBV3 228. As the voltage level of FBV3 decreases the output of the amplifier 322 drives the gate of transistor 324 such that current can begin to flow through the transistor. Thus, the third current cell 208 is enabled to pass the current IG2 140. For example, graph D of FIG. 8 illustrates how the upstream current cell 208 is enabled.

At block 926, the fourth current cell 210 turns off completely when there is no longer enough input voltage at terminal 124 to enable current to flow through the transistor 328. As a result, G3 is turned off and only G1 and G2 are turned on and visible as the current IG2 flows.

At block 928, a determination is made as to whether (due to the decreasing input voltage) the current in the third cell has decreased enough to cause the second cell to begin to turn on. In an exemplary embodiment, as the current level of IG2 decreases the voltage level at VOUT also decreases. This results in a corresponding decrease of the level of FBV2 226. As the voltage level of FBV2 decreases the output of the amplifier 318 drives the gate of transistor 320 such that the current IG1 can begin to flow through the transistor 320. Thus, the second current cell 206 is enabled to pass the current IG1 132 as the current IG2 140 begins to decrease. For example, graph E of FIG. 8 illustrates how the upstream current cell 206 is enabled.

At block 930, the third current cell 208 turns off completely when there is no longer enough input voltage at terminal 122 to enable current to flow through the transistor 324. When this occurs, G2 is turned off and only G1 is turned on and visible as the current IG1 continues to flow.

At block 932, a determination is made as to whether (due to the decreasing input voltage) the current in the second cell has decreased enough to cause the first cell to begin to turn on. In an exemplary embodiment, as the current level of IG1 decreases the voltage level at VOUT also decreases. This results in a corresponding decrease of the level of FBV1 224. As the voltage level of FBV1 decreases the output of the amplifier 314 drives the gate of transistor 316 such that the current I1 can begin to flow through the transistor 316. Thus, the first current cell 204 is enabled to pass the current I1 216 as the current IG1 132 begins to decrease. For example, graph F of FIG. 8 illustrates how the upstream current cell 204 is enabled.

At block 934, the second current cell 206 turns off completely when there is no longer enough input voltage at terminal 120 to enable current to flow through the transistor 320. When this occurs, G1 is turned off and thus no LED groups are visible as the current I1 continues to flow.

At block 936, a determination is made as to whether the input voltage has decreased enough to disable the first current cell 204. In an exemplary embodiment, as the input voltage decreases the level of current I1 also decreases. Thus, the first current cell 204 is disabled.

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. An apparatus comprising:

a plurality of LED groups connected in series to form an LED string that has a first node, a last node, and one or more intermediate nodes;

a plurality of current cells having inputs coupled to the first, last and intermediate nodes, respectively, and outputs coupled to an output resistor, and wherein each current cell selectively regulates current flowing between its respective input and the output resistor based on its respective feedback voltage; and a feedback circuit that generates a plurality of feedback voltages from a voltage level at the output resistor.

2. The apparatus of claim 1, wherein the first node is connected to receive an LED drive signal.

3. The apparatus of claim 2, wherein the LED drive signal is a rectified AC signal.

4. The apparatus of claim 1, wherein each current cell includes an input to receive a current setpoint voltage (CSPV).

5. The apparatus of claim 1, wherein upstream current cells comprise current cells connected to the LED string between a selected node connected to a selected current cell and the first node, and wherein enabling the selected current cell causes the upstream current cells to be disabled.

6. The apparatus of claim 1, further comprising a reference circuit that generates the CSPV from the LED drive signal.

7. The apparatus of claim 6, wherein the reference circuit includes a resistor divider network that generates a scaled version of the LED drive signal as the CSPV.

8. The apparatus of claim 1, wherein each current cell comprises:

an amplifier that receives the CSPV at a non-inverting input and a feedback voltage at an inverting input to generate a gate signal at an amplifier output; and a transistor that receives the gate signal at a gate terminal and controls current flow through the current cell.

9. The apparatus of claim 8, wherein each current cell comprises a current source that generates a bias current.

10. The apparatus of claim 9, wherein the feedback circuit comprises voltage offset generators that generate voltage offsets based on the bias currents generated by the current cells.

11. The apparatus of claim 10, wherein the feedback circuit generates the feedback voltages by combining the voltage offsets with the voltage level at the output resistor.

12. The apparatus of claim 11, wherein a fourth feedback voltage has a level substantially equal to the voltage level at the output resistor, a third feedback voltage has a level that is 10 millivolts higher than the fourth feedback voltage, a second feedback voltage has a level that is 10 millivolts higher than the third feedback voltage, and a first feedback voltage has a level that is 10 millivolts higher than the second feedback voltage.

13. The apparatus of claim 12, wherein the first feedback voltage is input to a first current cell that is connected to the first node, the second feedback voltage is input to a second current cell that is connected to a first intermediate node, the third feedback voltage is input to a third current cell that is connected to a second intermediate node, and the fourth feedback voltage is input to a fourth current cell that is connected to the last node.

14. A system comprising:

a plurality of LED groups connected in series to form an LED string that has a first node, a last node, and one or more intermediate nodes;

means for regulating current flows from the first, last, and intermediate nodes to an output terminal, wherein the current flows from the first, last, and intermediate nodes are regulated based on a plurality of feedback voltages;

an output resistor that generates an output voltage at the output terminal based on the regulated current flows; and means for generating the feedback voltages from the output voltage and for preventing current from flowing through upstream nodes when a downstream node is selected.

15. The system of claim 14, wherein the means for regulating is a plurality of current cells, and wherein the means for generating is a feedback circuit.

* * * * *